United States Patent [19]

Deslauriers

[11] 4,033,240

[45] July 5, 1977

[54] ROTARY STRIPPING WHEEL

[76] Inventor: Clovis F. Deslauriers, 25-52 Borough Place, Woodside, N.Y. 11377

[22] Filed: May 14, 1975

[21] Appl. No.: 577,477

[52] U.S. Cl. ..... 93/36 A; 83/103; 225/99

[51] Int. Cl.[2] ..... B26F 3/00; B31B 1/14

[58] Field of Search ..... 93/36 A; 83/103, 310, 83/332, 678, 110, 114; 225/97, 98, 99

[56] References Cited

UNITED STATES PATENTS

| | | | |
|---|---|---|---|
| 845,764 | 3/1907 | Curtis | 83/332 X |
| 2,615,376 | 10/1952 | Pelikan | 93/36 A |
| 2,875,799 | 3/1959 | Weems | 225/97 |
| 3,103,961 | 9/1963 | Milligan | 83/103 X |
| 3,128,929 | 4/1964 | Ruud | 225/93 X |
| 3,903,769 | 9/1975 | Jury | 83/332 X |

*Primary Examiner*—Willie G. Abercrombie
*Attorney, Agent, or Firm*—Karl L. Spivak

[57] ABSTRACT

A plurality of transversely adjustable rotary stripping wheels of general disc-like configuration for use in a stripping machine for removing automatically the waste material from die cut blanks. The outer periphery of the stripping wheel is knurled to enhance frictional engagement between the wheel and the waste material during the stripping operation. A plurality of half-rounds are milled or otherwise provided in spaced locations about the periphery of the stripping wheel to provide a positive gripping action upon the leading edge of the die cut waste to urge the leading edge downwardly during the stripping operation.

7 Claims, 4 Drawing Figures

ROTARY STRIPPING WHEEL

BACKGROUND OF THE INVENTION

The present invention relates generally to the paper converting industry and more particularly is directed to a rotary stripping wheel of improved design for stripping waste material from previously die cut blanks.

The present invention is designed for use with rotary type stripping machines which include a plurality of transversely spaced stripping blades of the type generally disclosed in my copending U.S. patent application Ser. No. 346,337, filed Mar. 30, 1973 entitled Stripping Machine, now U.S. Pat. No. 3,889,863.

The rotary stripping blades of the previously used design were generally disk-like in configuration and had a smooth outer periphery. These prior art stripping blades or stripping wheels were generally acceptable for the purpose and performed the stripping operations as designed. However, it has been found that certain slippage or lost motion occurred between the die cut waste materials and the periphery of the blade and this slippage has resulted in certain lost efficiency. On occasion, the interaction between the stripping wheels and the waste materials has resulted in damage to the finished product.

SUMMARY OF THE INVENTION

The present invention relates to a rotary stripping wheel for use in a stripping machine which includes construction designed for waste material engaging purposes to increase the efficiency of the stripping operation.

The rotary stripping wheel of the present invention incorporates a generally disk-like rotary blade or wheel which has its outer periphery positioned to contact the previously die cut waste portions of die cut blanks for waste stripping purposes. A plurality of stripping blades or wheels are positioned upon a stripping wheel shaft for simultaneous rotation during the stripping operation. These wheels are readily transversely adjustable along the shaft to align one stripping wheel with each aisle of waste material in the die cut sheet. A sufficient number of stripping wheels are provided to permit one stripping wheel to longitudinally align with each of the aisles previously defined in the die cut sheets to thereby automatically separate the waste from the finished product.

The die cut sheets are individually fed to the stripping section of a stripping machine and are delivered to the nip of input rollers. The stripping wheels position rearwardly of the input rollers and are fabricated to a diameter approximately 25 percent greater than that of the input rollers. The stripping wheel shaft positions on the stripping machine relative to the nip of the input rollers in a manner to project a portion of the stripping wheels beyond a plane drawn through the horizontal path of the travel of the die cut sheets through the stripping section. As the sheets are fed through the stripping machine, the finished, stripped product travels through the space defined between the transversely spaced stripping wheels under impetus of pairs of cooperating rollers in the stripping section. The die cut waste portions contact the stripping wheels at the previously designed longitudinal aisles and are forced downwardly or upwardly away from the plane of the travel of the finished product. The downward (or upward) projection of the periphery of the plurality of transversely spaced stripping wheels causes the waste material to travel downwardly (or upwardly) out of the plane of the path of travel of the finished product and this waste material is then directed exteriorly of the stripping machine for disposal purposes.

The outer periphery of each rotary stripping wheel is provided with a plurality of peripherally spaced surface indentations preferably in the form of half-rounds which may be milled or otherwise provided in the stripping wheel. The remainder of the outer periphery of the stripping wheel intermediate the indentations or half-rounds is knurled or otherwise treated to provide a roughened outer surface. The roughened outer surface and the plurality of surface indentations cooperate to increase the efficiency of the stripping operation by contacting and forcing the waste material downwardly (or upwardly) out of the plane of travel of the finished product in the stripping section.

When stripping die cut blanks from a sheet of cardboard or similar material it is important that the velocity of the stripping wheels exceed the velocity of the sheet as it travels through the mechanism. In this manner, the rotational speed of the stripping wheels can be employed to positively frictionally drive the waste portions away from the finished product to provide a highly efficient stripping operation. I have found that a ratio of the peripheral speed of the stripping wheels to the speed of sheet travel of from 1.1:1 to 3:1 or 4:1 to be the most advantageous. The increased speed of the stripping wheels may cause several of the surface indentations to contact the waste material as it is being stripped. These multiple contacts can aid in separating the waste from the finished products by creating a vibratory effect.

It is therefore an object of the present invention to provide an improved rotary stripping wheel of the type set forth.

It is another object of the present invention to provide a novel rotary stripping wheel suitable for stripping previously die cut sheet material in an automatic manner.

It is another object of the present invention to provide a novel stripping blade which includes frictional means for engaging the waste portions of a previously die cut strip.

It is another object of the present invention to provide a novel rotary stripping wheel including a plurality of milled half-rounds in the outer periphery thereof for work contacting purposes.

It is another object of the present invention to provide a novel rotary stripping wheel of generally disk-like configuration having an outer periphery in which the surface thereof is knurled or otherwise treated to present a roughened surface for work contacting purposes.

It is another object of the present invention to provide a novel rotary stripping wheel of disk-like configuration having a plurality of indentations formed in the outer periphery thereof in spaced relationship and having the remainder of the peripheral surface knurled or otherwise treated to provide a roughened surface.

It is another object of the present invention to provide a novel rotary stripping wheel that is rugged in construction, simple in design and trouble free when in operation.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figures 1, 2:
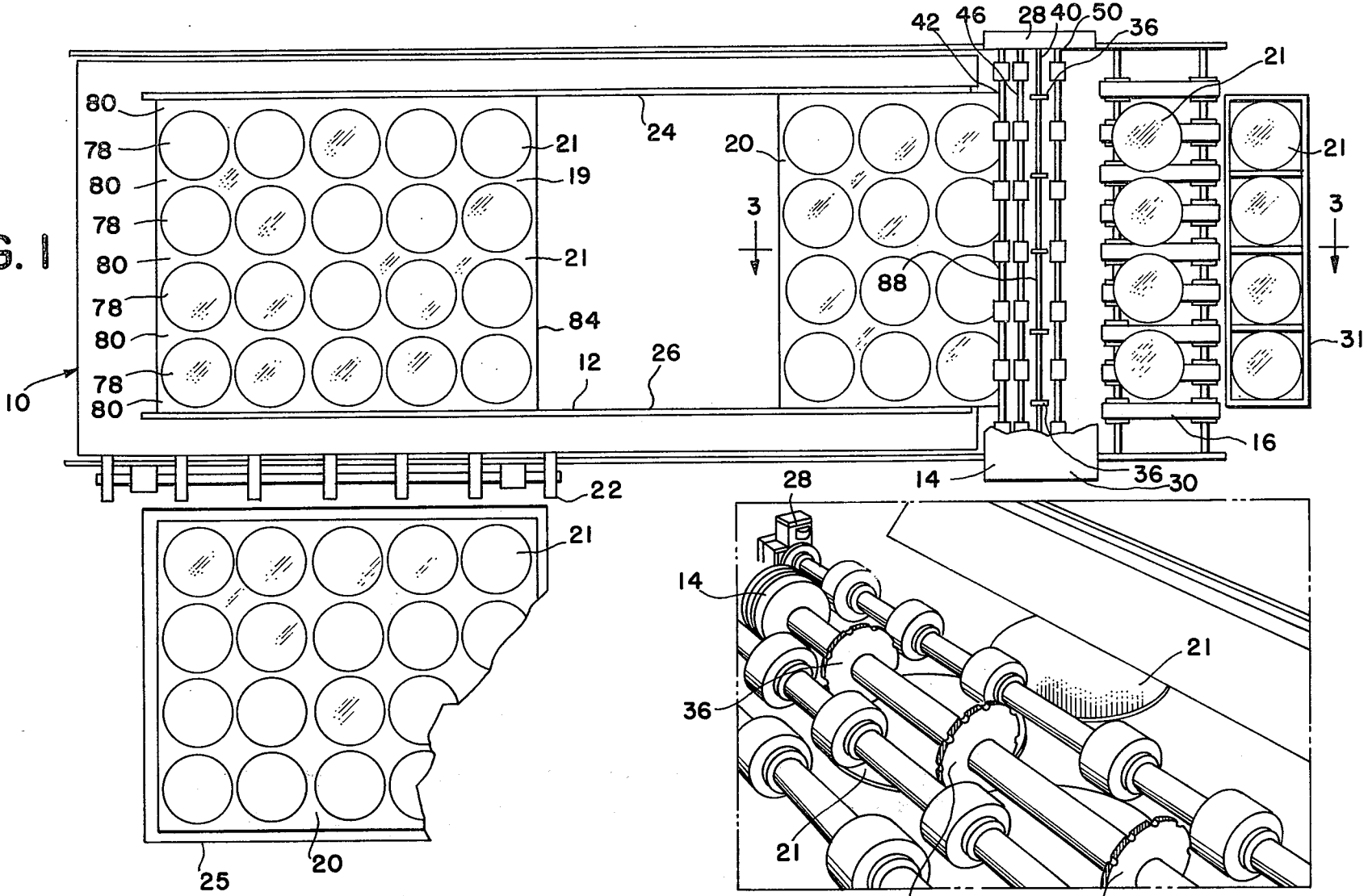
FIG. 1 is a top plan view of a stripping machine employing the rotary stripping wheel in accordance with the present invention.
FIG. 2 is an enlarged, partial, perspective view of the stripping section of FIG. 1.

Although specific terms are used in the following description for the sake of clarity, these terms are intended to refer only to the particular structure of my invention selected for illustration in the drawings and are not intended to define or limit the scope of the invention.

Figures 3, 4:
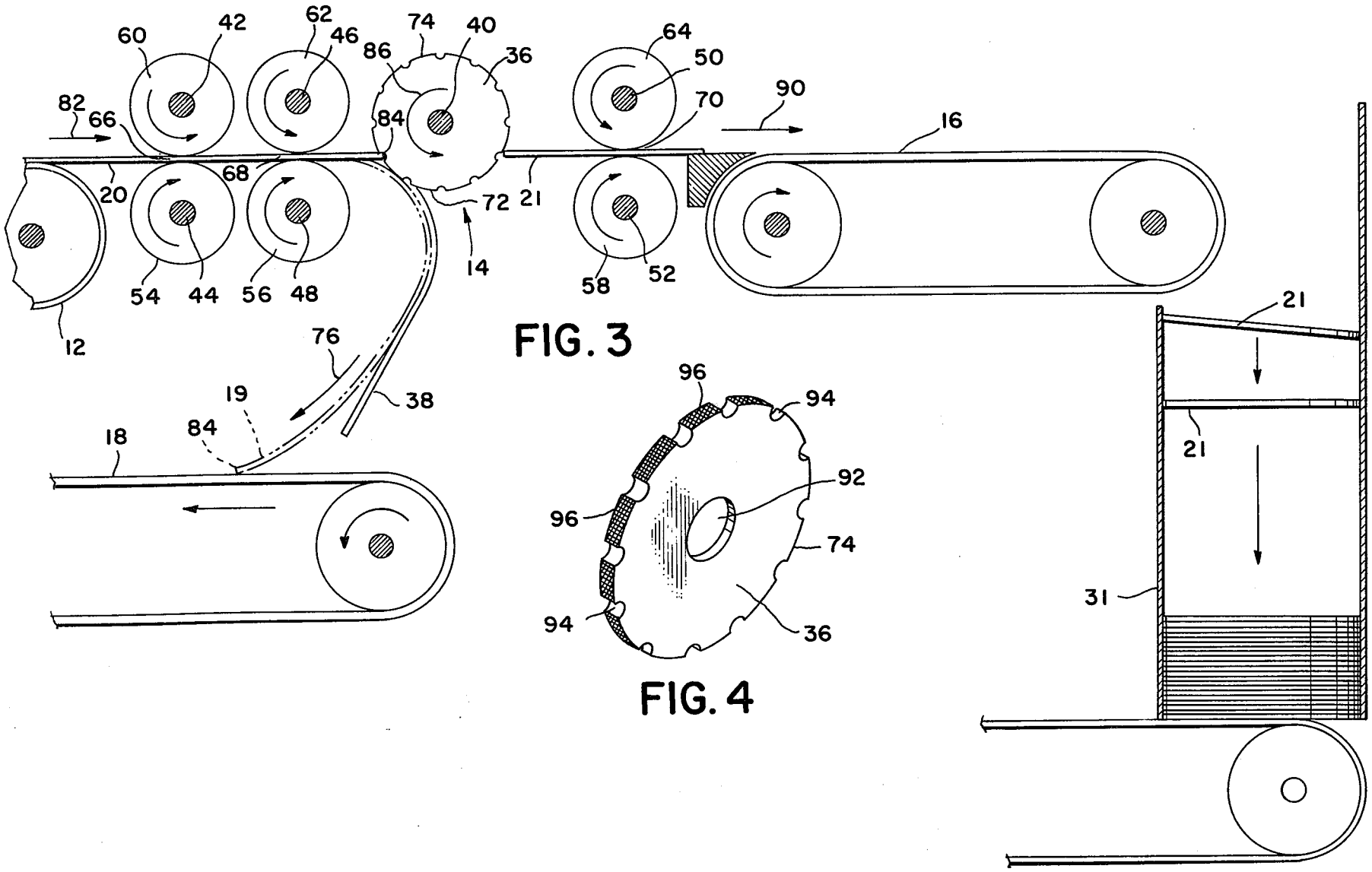
FIG. 3 is an enlarged, partial, cross sectional view taken along line 3—3 of FIG. 1, looking in the direction of the arrows.
FIG. 4 is an enlarged perspective view of a single stripping wheel constructed in accordance with the teaching of the present invention.

Referring now to FIGS. 1, 2 and 3, a stripping machine 10 is illustrated including a feed conveyor 12 which carries previously die cut sheets 20 to the machine stripping section 14. Following stripping in the stripping section 14, the stripped finished product 21 is carried by an output conveyor 16 to a suitable stacking means of known design for subsequent delivery to the end user. The previously die cut sheets 20 are delivered individually by a conventional sheet feeding mechanism 25 to the feed conveyor 12 in a well known manner and side rollers 22 may be conventionally employed if so desired. A pair of longitudinally extending, spaced, transversely adjustable guides 24, 26 are carried above the feed conveyor 12 to transversely align the die cut sheets 20 as they are carried toward the stripping section 14. A waste conveyor 18 receives the separated waste material 19 as it is stripped from the blank 20 by function of the rotary stripping wheels 36 as hereinafter more fully set forth. The curved baffle 38 may be employed to direct the separated waste material 19 to the waste conveyor 18 by serving as a guide.

The stripping section 14 positions immediately rearwardly of the feed conveyor 12 and is provided with conventional, transversely spaced, pairs of bearing means 28, 30 to conventionally journal a plurality of roller shafts 42, 44, 46, 48, 50 and 52, and the stripping wheel shaft 40. The stripping section 14 comprises a plurality of driving rollers 54, 56, 58 which are conventionally affixed to and which are rotatively driven by their respective driving shafts 44, 48 and 52. A plurality of driven rollers 60, 62, 64 are conventionally affixed to the roller shafts 42, 46 and 50 respectively. The driven rollers 60, 62, and 64 respectively vertically register over the driving rollers 54, 56 and 58 and are simultaneously rotated thereby frictional, tangential contact. The upper shaft bearings 28, 30 are preferably spring biased to urge the upper shafts 42, 46, 50 downwardly toward the lower roller shafts 44, 48 and 52. The cooperating pairs of driving and driven rolles 54, 60; 56, 62; and 58, 62 define respective nips 66, 68 and 70 therebetween for sheet receiving and sheet driving purposes. See FIG. 3.

The respective driving and driven pairs of rollers 54, 60, 56, 62 and 58, 64 may be fabricated of hard rubber or plastic and may be segmented design as illustrated in FIGS. 1 and 2 or may be of solid cylindrical configuration (not shown) in accordance with teachings well known to those skilled in the art. The driven roller shafts 42, 46 and 50 are conventionally continuously urged downwardly toward the driving roller shafts 44, 48, 52 by the spring biased upper shaft bearings to force the driven rollers 60, 62 and 64 against the respective driving rollers 54, 56 and 58 to assure positive traction for sheet driving action.

The stripping blade shaft 40 positions intermediate the forward pairs of driving and driven rollers 54, 60, 56, 62 and the rearwardly positioned pair of driving and driven rollers 58, 64 for stripping purposes. The gears or other drive mechanism (not shown) of the stripping section 14 are conventionally arranged to rotate the plurality of stripping blades 36 at a higher rotational speed than the other rollers comprising the stripping section. The rotary stripping wheels 36 are preferably fabricated to a diameter that is greater than the diameter of the driving and driven rollers, for example, on the order of a ratio of 4:3. The stripping wheel shaft 40 is journalled within the transversely spaced bearing means 28, 30 at a suitable elevation to carry the bottom peripheries 72 of the stripping wheels 36 below a horizontal feed plane drawn through the respective roller nips 60, 68, 70 which are defined between the respective pairs of driving and driven rollers. The waste materials 19 are stripped from the die cut sheets 20 by action of the lower periphery 72 of the stripping wheels 36 which act to force the waste downwardly from the plane of travel in the direction of the arrow 76 (FIG. 3).

The rotational velocity at the periphery 74 of each stripping wheel 36 is greater than the velocity of travel of each blank 20 through the stripping machine 10. This increase in velocity may be accomplished either by rotating the stripping wheel shaft 40 at the same speed as the driving roller shafts 44, 48, 52 and relying upon the greater diameter of the stripping wheels as compared to the driving and driven rollers to account for the increased velocity. Optionally, the gearing (not shown) in the stripping section 14 may be conventionally designed to rotate the stripping wheel shaft 40 at a greater rotational speed than the driving roller shafts 44, 48, 52.

As best seen in FIG. 1, each die cut sheet 20 is previously die cut or otherwise treated to provide a plurality of individual die cut finished products 21 of a desired configuration suitable for the purpose for which the finished product 21 is being manufactured. The remaining material of the blank 20 intermediate the finished products 21 is waste material 19 which will be automatically removed upon operation of the stripping machine 10. The finished products 21 are longitudinally aligned in longitudinally extending finished product rows 78. Intermediate the finished product rows 78 are a plurality of longitudinally extending, transversely spaced waste material strip rows 80 which preferably are approximately one-half inch in width. A sufficient number of stripping wheels 36 are transversely spaced along the stripping wheel shaft 40 to position one stripping wheel 36 in longitudinal alignment with each waste material strip row 80. As the feed conveyor 12 drives the die cut blanks 20 individually towards the stripping section 14 in the direction of the arrow 82, the leading edge 84 of each die cut sheet 20 is simultaneously contacted by the plurality of transversely spaced stripping wheels 36. The wheels 36 are rotated in the direction of the arrow 86 for waste stripping purposes.

The position of the bottom peripheries 72 below the plane of travel of the sheet 20 combined with the increased velocity of the rotary stripping wheels 36 acts to drive the waste portions 19 downwardly as indicated by the arrow 76 for subsequent disposal. The stripped finished products 21 pass between the spaces 88 defined between adjacent stripping wheels 36 and are carried by the driven and driving rolls 58, 64 in the direction of the arrow 90 to the finished product conveyor 16 for subsequent introduction to the finished product chute 31, or other suitable point of deposit.

As best seen in FIG. 4, each stripping wheel 36 is preferably formed to a disk-like configuration and includes an outer periphery 74 for work contacting purposes. The stripping wheel 36 includes a concentric opening 92 which may include a keyway (not shown) to receive the stripping wheel shaft 40 therein in conventional manner. Means (not shown) such as set screws, are provided to easily tighten the stripping wheel 36 to the stripping wheel shaft 40 in a conventional manner well known to those skilled in the art. Additionally, the stripping wheels 36 are made easily adjustable transversely along the stripping wheel shaft 40, also in conventional manner, to thereby easily align one stripping wheel with each waste material aisle or row 80 provided in the die cut blank 20. The outer periphery 74 is provided with a plurality of peripherally spaced indentations 94 which may be in the form of milled half-rounds. As illustrated in FIG. 3, the indentations 94 serve to receive the leading edge 84 of the blank 20 and to positively grip and turn the leading edge downwardly for stripping purposes. The remainder 96 of the stripping wheel periphery intermediate the indentations 94 is knurled to provide an increased frictional surface to further aid in contacting and driving the waste material 19 downwardly as the stripping wheels 36 are rotated in the direction of the arrow 86. It is contemplated that the indentations 94 and the intermediate knurled portions 96 cooperate to frictionally engage and to urge the waste portions 19 downwardly out of the plane of travel of the finished products 21, for positive waste stripping purposes.

The milled half-rounds or indentations 94 positively grip or otherwise engage the leading edge of each die cut sheet as it travels through the stripping section 14 to force the waste material rows 80 downwardly. Also, due to the increased rotational speed of the stripping wheels 36, it is possible for more than one indentation 94 to strike a waste material row 80. Thus, multiple impacts of indentations 94 upon the waste material rows 80 is contemplated to aid in separating the waste material 19 from the finished products.

Although I have described my invention with a certain degree of particularlity, it is understood that the present disclosure has been made only by way of example and that numerous changes in the details of construction and the combination and arrangement of parts may be resorted to without departing from the scope of the invention.

I claim:

1. A waste stripping apparatus of the type employing rotary stripping wheels to remove waste material from the finished product, wherein previously die cut sheets having a leading edge and a plurality of transversely spaced waste rows are fed along a plane to the stripping wheels, which comprises a plurality of rotary stripping wheels each having a portion of its outer periphery extending below the plane of sheet travel, at least a portion of the outer periphery of the wheels being provided with surface indentations, at least one said surface indentation being positioned below the said plane at all times, said surface indentations being movable into alignment with said plane;

and means to transversely space at least some of the stripping wheels to align a stripping wheel with a waste row, whereby said indentations can be positioned to contact the leading edges of the sheets to aid in stripping waste from finished product.

2. A waste stripping apparatus according to claim 1 wherein at least one indentation is positioned in alignment with the said plane whereby the indentation grips the leading edge at a waste row to force the waste row out of the plane of sheet travel.

3. A waste stripping apparatus according to claim 2 wherein the surface indentations define peripheral surfaces therebetween and wherein portions of the peripheral surfaces contact portions of the waste rows rearwardly of the said leading edge, the peripheral surfaces being below the said plane when in contact.

4. A waste stripping apparatus according to claim 3 wherein a portion of the peripheral surfaces is knurled.

5. A waste stripping apparatus according to claim 3 wherein all of the peripheral surfaces are knurled.

6. A waste stripping apparatus according to claim 1 wherein the die cut sheets are fed longitudinally through the apparatus at a first speed and the stripping wheels are rotated to develop a peripheral surface speed wherein the peripheral surface speed exceeds the said first speed.

7. The waste stripping apparatus according to claim 6 wherein the ratio of peripheral surface speed of a wheel to the said first speed is between approximately 1.1 to 1 to 4 to 1.

* * * * *